United States Patent [19]

Coller et al.

[11] Patent Number: 4,662,694

[45] Date of Patent: May 5, 1987

[54] RESILIENT BEAM ELECTRICAL TERMINAL

[75] Inventors: James R. Coller; Lawrence Macioce, both of Kernersville, N.C.

[73] Assignee: AMP Incorporated, Harrisburg, Pa.

[21] Appl. No.: 715,794

[22] Filed: Mar. 25, 1985

[51] Int. Cl.[4] ..... H01R 4/02

[52] U.S. Cl. ..... 339/275 T; 339/258 R

[58] Field of Search ..... 339/95 R, 258 R, 258 P, 339/275

[56] References Cited

U.S. PATENT DOCUMENTS

| | | | |
|---|---|---|---|
| 3,596,235 | 7/1971 | Hendriklaan | 339/258 R |
| 3,685,001 | 8/1972 | Krafthefer | 339/258 R |
| 4,159,158 | 6/1979 | Weidler . | |

FOREIGN PATENT DOCUMENTS

| | | | |
|---|---|---|---|
| 2318519 | 2/1977 | France | 339/258 R |

*Primary Examiner*—Joseph H. McGlynn
*Attorney, Agent, or Firm*—Robert W. Pitts

[57] ABSTRACT

An electrical connector includes a stamped and formed terminal for establishing electrical contact with a terminal post having a rectilinear cross section. The terminal has at least one resilient beam which has a contact area having an arcuate cross section. The concave surface of the arcuate cross section engages the edge of the terminal posts to provide a good electrical connection even if excess solder is deposited on the exterior of the terminal post in the vicinity of the contact region.

2 Claims, 7 Drawing Figures

RESILIENT BEAM ELECTRICAL TERMINAL

BACKGROUND OF THE INVENTION

1. Field of the Invention

This invention relates to electrical connectors and more particularly to resilient beam terminals or engaging square posts soldered to printed circuit boards.

2. Description of the Prior Art

Electrical connectors for use in establishing continuity between terminal posts mounted on a panel board or printed circuit board are conventional. For example the connector disclosed in U.S. Pat. No. 4,159,158 is used to interconnect discrete wires to discrete terminal posts mounted on 0.100 or 0.156 inch centers on a panel board or printed circuit board. When used under the conditions for which these connectors were intended, excellent performance is achieved. These connectors provide a low cost interconnection system which is especially important because large numbers of such connectors are required for use in systems in the electronics industry.

Conventional connectors such as those disclosed in the above-mentioned patent employ resilient beam structure for engaging the surfaces of terminal posts, having a rectilinear or square cross section. When contact is established with the conductive metal forming such terminal posts, excellent performance can be achieved. However, under certain conditions the surface of these square terminals can become contaminated. For example, when terminal posts soldered to a printed circuit board are employed, it is not uncommon for the solder flux and contamination to build up along the side of the post from the area immediately adjacent the printed circuit board over the entire terminal post. The physics underlying such soldered interconnections generally result in a greater build-up of solder flux along each face of the post than would occur adjacent the corners of the post. Indeed the minimum thickness of solder flux would be at the corners of the square posts. Some users do not remove this undesirable solder flux contamination buildup from terminal posts and a conventional resilient beam terminal would engage the solder flux or contamination, at its maximum thickness, rather than the underlying terminal posts. Indeed when conventional resilient beam terminals are mated with conventional square posts having a solder flux buildup, high resistance is generally encountered and opens may occur. It is therefore an object of this invention to provide a resilient beam contact which can form a suitable contact with a terminal post having a square cross section even if considerable solder flux is present on the exterior of the terminal posts in the vicinity of the contact area.

SUMMARY OF THE INVENTION

A resilient beam contact terminal, which can be positioned within an insulating housing and terminal posts having a rectilinear or square cross section are employed to establish an electrical interconnection between the traces of a printed circuit board and discrete conductors such as wires individually attached to the respective terminals. The terminal posts are soldered to a printed circuit board to establish electrical interconnection with traces or circuits on the printed circuit board or panel. The posts can be of conventional construction and have a generally square cross section. Each terminal has a resilent beam structure for establishing a spring contact with the terminal posts. In the preferred embodiment of the invention, each terminal has two beams, one an active spring biased beam and the other a generally passive member. The active spring beam has an arcuate cross section along the portion of the beam in engagement with the terminal. The concave surface of the beam is located adjacent the terminal and the beam contact surface engages the corners rather than the sides of the rectilinear terminal posts. Thus contact is made with the conductive metal forming the terminal posts rather than the solder flux which may be present on the exterior of the posts at the corners where the flux contamination is minimal rather than the flat sides where the flux contamination is thickest.

DETAILED DESCRIPTION OF THE PREFERRED EMBODIMENT

Figure 1:
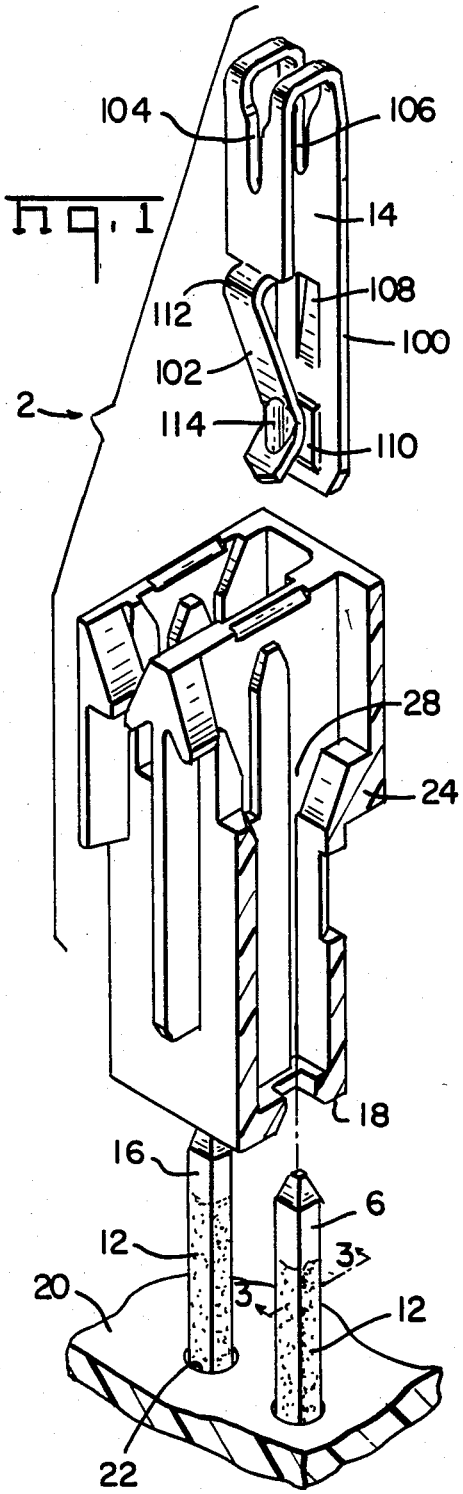
FIG. 1 is an exploded perspective view showing the resilient beam terminals in relation to an insulating housing and to terminal posts soldered in a printed circuit board.

As shown in FIG. 1, the connector 2 of the invention comprises a connector housing 24 and terminals 14 for disengageably connecting individual wires 4 to spaced apart terminal posts 6 which are mounted in and extend from a panel board or printed circuit board 8. Although FIG. 1 depicts the terminal posts 6 mounted directly in the panel or printed circuit board 8, it is also a common practice to mount the terminal posts 6 in a header at the time of manufacture of the posts so that the header having a plurality of posts therein can then be assembled to the panel or printed circuit board by aligning the posts and the header with holes in the panel inserting the lower ends of the posts through the holes. The lower portions of the post 6 would in either case be soldered to conductors or traces on a surface of the printed circuit or panel member.

Figure 4:
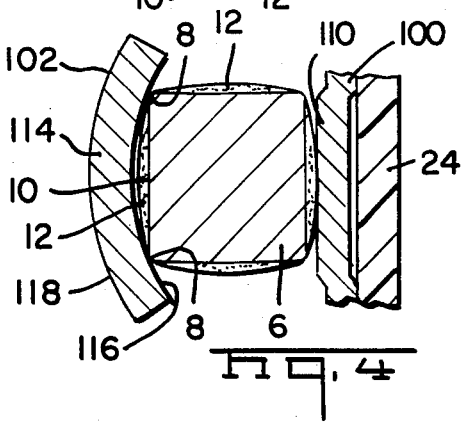
FIG. 4 is a sectional view showing the cross section of the resilient beam and the nonactive beam in the terminal at the same section of the contaminated square post as shown in FIG. 3.

The connector 2 comprises an insulating housing having a plurality of contact terminals 14 contained therein. The housing 24 is generally prismatic and is advantageously of nylon or other material which can be manufactured by an injection molding process. A plurality of side-by-side cavities 28 extend through the housing from a wire-receiving face to a mating face through which posts 16 may be inserted. As shown in FIG. 4 when the apparatus is in its simple configuration a post 6 would extend through an opening along the mating face 18 of the connector housing. This opening in mating face 18 communicates with cavity 28 in which an individual terminal 14 is retained.

The individual terminals 14 comprise essentially an elongated strip of sheet metal which is reversely folded about its midpoint to provide two contact arms or beams 100 and 102. These two beams are part of a continuous strip of metal and the center reversely folded section has a pair of slots 104 and 106 defined therein. Slots 104 and 106 are in alignment and are adapted to receive a wire inserted laterally of its axis into engagement with the edges of these slots. The edges of slots 104 and 106 are normally spaced apart by width less than the diamter of the conductive core of the wire to form an insulation displacement wire termination.

One leg of terminal 14 comprises a nonactive contact beam 100 which has a lance 106 deflected outwardly into engagement with a suitable terminal retention recess on the housing. An flat embossed surface 110 is formed in the nonactive contact arm 100 in the contact region for engagement with a terminal post 6.

Figure 2:
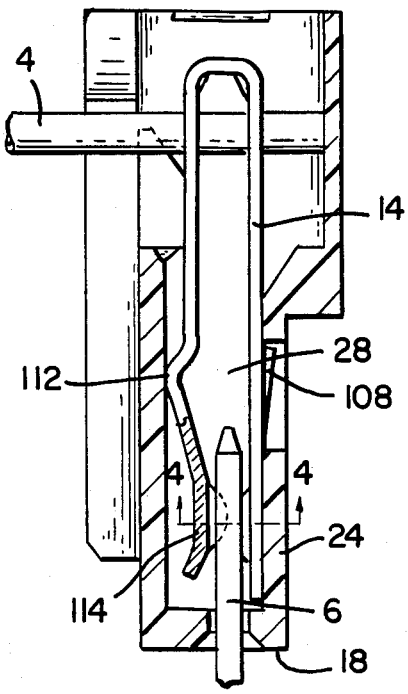
FIG. 2 is an elevational view showing a single terminal mounted in the housing in engagement with a terminal post soldered to a printed circuit board.

The other resilient beam 102 located on the opposite end of terminal 14 comprises a formed active spring member bent inwardly from the plane of the terminal containing slot 104. As shown in FIG. 2, the active beam has a radiused section 112 engaging the side of the housing and located immediately above an inwardly extending portion which is most closely adjacent beam 102 at contact section 114. Beam 102 then is bent outwardly from contact section 114 to its free end 116. Beam 102 in its unstressed configuration is positioned with contact section 114 closely adjacent to the embossed section 110 on beam 100. Insertion of a single post 4 into a cavity in the housing and between beams 100 and 102 results in the outward deflection of beam 102 with a resultant spring force urging beam 102 into engagement with post 6.

Figure 3:
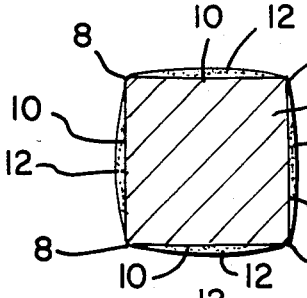
FIG. 3 is a sectional view of a single terminal post showing the distribution of solder around the terminal post at a location in which electrical contact is to be established with the terminal post by terminal resilient beam.

As shown in FIG. 4, the contact section 114 of beam 102 has an arcuate form rather than the rectilinear cross section of conventional dual beam structures. The arcuate section 114 has a convex outer surface 118 and a concave inner surface 116. The radius of curvature of the concave face 116 of arcuate section 114 is sufficiently great that surface 116 engages the corners 8 rather than the sides 10 of square post 6. Engagement between the active beam 102 and the corners 8 of a square post 6 is especially important where contact must be made with a post 6 which has solder flux contamination deposited around the exterior of the post. It has been found that solder flux wicking can often occur and the excess solder flux present on the exterior of a terminal post, even at a relatively great distance from the soldered joint, can seriously effect the adequacy of the electrical contact formed by a spring member such as terminal 14 since the flux and other contaminants act as insulators. It has been found that this solder flux wicking phenomenon results in greater solder flux deposition near the center of the sides of a post having a rectilinear cross section than at the edges of the post. This uneven distribution of solder flux and contamination 12 around a post 6 is depicted in FIG. 3. Not only would this invention provide an improved static contact with the edges of post 6 as shown in FIG. 4 at a point on the terminal post having solder flux deposited thereon, but the curved contour of beam 102 and section 114 would also provide a wiping action along the corners 8 of the terminal post as the terminals are inserted on terminal post 6. The wiping action would serve to remove any excess solder flux contamination deposited in the vicinity of corners 8 thus serving to establish a good electrical connection with the terminal posts.

Figure 5:
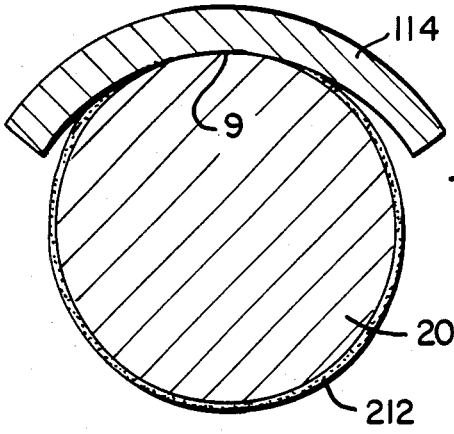
FIG. 5 is a sectional view showing the engagement between the terminal of FIG. 1 and a round post.

The arcuate cross section of the terminal also serves to establish improved electrical contact with a round post having a surface contaminated with solder flux. FIG. 5 shows the line or point contact between the contact section 114 and the round post 206 at 209. The contact section diverges from the contour of the round post 206 just as it diverges from the contour of the square post 6 so that a line contact, which appears as a point contact in FIG. 5 is formed. The contact forces at 8 or at 9 are thus increased to improve electrical continuity and reduce resistance in the presence of surface contamination due to solder flux buildup.

Figure 6:
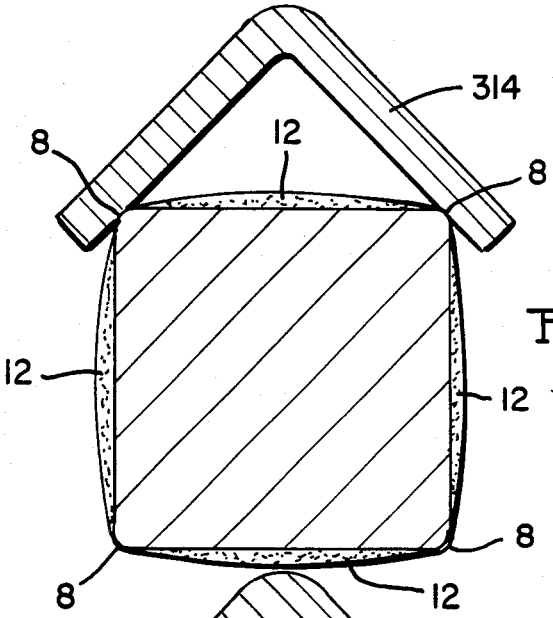
FIG. 6 is a sectional view of a terminal with an angular cross section and a square post.
Figure 7:
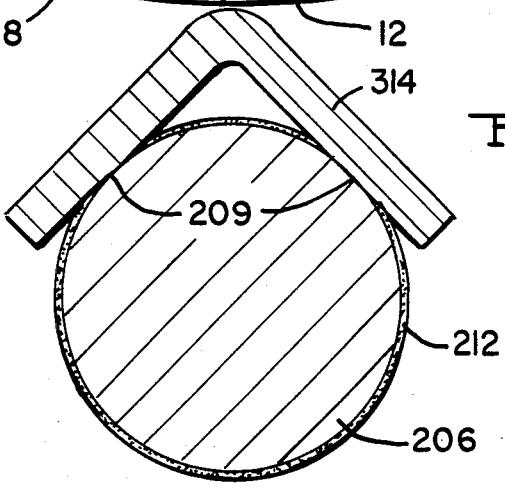
FIG. 7 is a sectional view of the terminal of FIG. 6 in engagement with a round post.

Although this invention has been described in terms of a preferred embodiment, it will be immediately apparent to one skilled in the art that this invention can be employed in a number of similar environments without departing from the true scope of the invention. For example a markedly distinct terminal configuration, still having a resilient beam contact might be substituted for terminal 14. For example, FIGS. 6 and 7 illustrate a terminal having a diverging angular cross section 314 establishing a localized contact with both a square post 6 and a round post 206. Excellent electrical contact is established at 8 and 209 respectively. Therefore the following claims are in no way limited to the specific preferred embodiment depicted herein.

We claim:

1. Apparatus for use in establishing electrical interconnection with traces on a printed circuit board, comprising:

a plurality of posts soldered to the traces on the printed circuit board, each post having a rectilinear cross section and having solder flux concentrated on the sides of the posts above the printed circuit board, the thickness of the solder flux at the edges of the rectilinear cross section being less than on the sides intermediate the edges, and an electrical connector having a plurality of terminals, each terminal including at least one axially extending resilient beam, the beam being resiliently deflectable from an initial position and resiliently urged into engagement with the post when positioned adjacent thereto, the resiliently urged beam having a contact section having an arcuate cross section, the concave face of the arcuate cross section being disposable adjacent the post engaging the corners of the post and comprising means for establishing an electrical connection with the terminal post instead of the solder flux concentrated on the sides of the post.

2. Apparatus for use in establishing electrical interconnection with traces on a printed circuit board, comprising:

a plurality of posts attached to the printed circuit board, each post having a rectilinear cross section and having a nonconductive contamination concentrated on the sides of the posts above the printed circuit board, the thickness of the nonconductive contamination at the edges of the rectilinear cross section being less than on the sides intermediate the edges, and an electrical connector having a plurality of terminals, each terminal including at least one axially extending resilient beam, the beam being resiliently deflectable from an initial position and resiliently urged into engagement with the post when positioned adjacent thereto, the resiliently urged beam having a contact section having an arcuate cross section, the concave face of the arcuate cross section being disposable adjacent the post engaging the corners of the post and comprising means for establishing an electrical connection with the terminal post instead of the nonconductive contamination concentrated on the sides of the post.

* * * * *